US011213708B2

(12) United States Patent
Casanova

(10) Patent No.: US 11,213,708 B2
(45) Date of Patent: Jan. 4, 2022

(54) MOBILE STANDPIPE TRAINING APPARATUS

(71) Applicant: Michael Alexander Casanova, Davie, FL (US)

(72) Inventor: Michael Alexander Casanova, Davie, FL (US)

( * ) Notice: Subject to any disclaimer, the term of this patent is extended or adjusted under 35 U.S.C. 154(b) by 0 days.

(21) Appl. No.: 17/167,427

(22) Filed: Feb. 4, 2021

(65) Prior Publication Data

US 2021/0244988 A1 Aug. 12, 2021

Related U.S. Application Data

(60) Provisional application No. 62/971,647, filed on Feb. 7, 2020.

(51) Int. Cl.
*A62C 99/00* (2010.01)

(52) U.S. Cl.
CPC ..... *A62C 99/0081* (2013.01)

(58) Field of Classification Search
CPC ..... A62C 99/0081
USPC ..... 434/226
See application file for complete search history.

(56) References Cited

U.S. PATENT DOCUMENTS

2007/0164127 A1* 7/2007 Lozier ..... A62C 31/00 239/71

OTHER PUBLICATIONS

"High-Rise Training," Bond et al., Firefighting in Canada, https://www.firefightingincanada.com/high-rise-training-6614/, Aug. 10, 2010 (Year: 2010).*
"Let's Talk Pressure Regulating," National Fire Sprinkler Association, https://web.archive.org/web/20191225084934/https://nfsa.org/2019/12/06/lets-talk-pressure-regulating/, Dec. 25, 2019 (Year: 2019).*
"Portland Standpipes Testing and Inspection," AFP Systems, http://www.afpsys.com/blog/portland-standpipes-testing-and-inspection/, Feb. 7, 2017 (Year: 2017).*
"Valuable Hands-On Training for the Recruits with Our New Standpipe PRV Prop!" Des Moines Fire Department (@DSMFireDept), twitter.com, https://twitter.com/dsmfiredept/status/867762546790592513?lang=en, May 25, 2017 (Year: 2017).*
"Standpipe System Design Guideline," Sioux Falls Fire Rescue, Fire Prevention Division, https://www.siouxfalls.org/~/media/Documents/fire/fire-prevention/permits/standpipe_system_design_guideline.pdf, Sep. 6, 2010 (Year: 2010).*

* cited by examiner

*Primary Examiner* — Jerry-Daryl Fletcher
*Assistant Examiner* — Jennifer L Korb
(74) *Attorney, Agent, or Firm* — The Concept Law Group, PA; Scott D. Smiley; Scott M. Garrett

(57) ABSTRACT

A firefighting training apparatus includes a base having a feed pipe mounted on the base, and one or more standpipes mounted on the feed pipe. Each standpipe can have one or more couplings that are configured to receive a field adjustable pressure reducing valve that is further configured to connect to a firehose or other firefighting equipment. The apparatus is reconfigurable, and various different types of field adjustable pressure reducing valves can be mounted on the standpipe(s) for use in different training exercises or simply to allow firefighter to become familiar with operating the field adjustable pressure reducing valves under training conditions.

13 Claims, 6 Drawing Sheets

100

MOBILE STANDPIPE TRAINING APPARATUS

CROSS-REFERENCE

This application claims the benefit of U.S. Provisional Application No. 62/971,647, filed Feb. 7, 2020, the entirety of which is hereby incorporated by reference.

FIELD OF THE INVENTION

The present invention relates generally to fire fighter training, and, more particularly, relates to a mobile apparatus for training in the operation and use of various standpipe systems used in high rise buildings.

BACKGROUND OF THE INVENTION

High rise buildings are required to have standpipes located on each floor of the building. to which firefighting equipment can be connected in order to provide water for fire suppression. Standpipes are supplied with water under pressure, typically provided by a fire pump. As a result, the pressure at lower floors can be significantly higher than the water pressure in standpipes connected to the same fire pump at higher floors. Since firefighting equipment is designed to operate at specific pressures, which are typically lower than that evident at a standpipe, standpipes are fitted with field adjustable pressure reducing valves. This ensures that firefighters can control the water pressure to an appropriate level for their equipment. When pressure is too low, the effect of the equipment is less than optimal; if pressure is too high, the equipment becomes increasingly difficult to control, and excessive pressure can stress equipment to the point of failure. There are number of different types and designs of pressure regulating standpipe valves that have been installed in buildings. As a result, a firefighter needs to be familiar with these various types of valves as any of them may be encountered in a given building. At the same time, fires in these buildings can be extremely rare. As a result, many firefighters are never exposed to these types of valves on a deployment and only see them during training. That makes training much more important so that firefighters will be prepared if they do have to respond to an actual fire in a high rise building.

A typical training facility for using various types of standpipe valves is a multi-floor fixed structure made to resemble the configuration of a portion of a high rise building. On each floor there can be different types of valves installed, with water under pressure being supplied to the pipe system, giving firefighters an opportunity to operate and adjust these valves under training conditions. This conventional approach to training firefighters how to use standpipe valves, and give them experience operating these valves, therefore requires firefighters to travel to the training facility. There are substantial costs associated with this type of training. For one, when sending firefighting personnel to the training facility resources for that firehouse house are committed to the training exercise and used to transport personnel to and from the training facility. There are costs associated with either paying personnel to train on what would otherwise be time off, or to pay personnel to cover shifts while others are on a training assignment, or to simply have a house at a reduced staff while some personnel are training. As a result, training for operating and using standpipe field adjustable pressure reducing valves is not undertaken as often as would be optimal or desirable.

Therefore, a need exists to overcome the problems with the prior art as discussed above.

SUMMARY OF THE INVENTION

In accordance with some embodiments of the inventive disclosure, there is provide a mobile standpipe training apparatus for training firefighters that includes a feed pipe having a first end and a second end, the second end being closed, the first end being configured to receive water under pressure. The apparatus can further include a plurality of standpipes, each one of the plurality of standpipes extending upwards from the feed pipe, and being fluidly coupled to the feed pipe at a base of the standpipe and closed or capped at a top of the standpipe. Each one of the plurality of standpipes having at least one valve coupling extending from a side of the standpipe, the at least one valve coupling configured to receive a field adjustable pressure reducing valve. The apparatus can further include a pair of feet coupled to a bottom of the feed pipe configured to hold the standpipe apparatus upright, wherein one of pair of feet is disposed adjacent the first end of the feed pipe and the other of the pair of feet is disposed at the adjacent the second end of the feed pipe. The apparatus can further include a cross member having a first end coupled to a distal end of the one of the feet adjacent the first end of the feed pipe and a second end coupled to a distal end of the other of the feet adjacent the second end of the feed pipe. The apparatus can also include a plurality of brace members, wherein each one of the brace members is coupled to a respective one of the plurality of standpipes and the cross member.

In accordance with a further feature, the apparatus can further include, on at least one of the plurality of standpipes, an isolation valve coupled fluidly between the at least one of the plurality of standpipes and the feed pipe.

In accordance with a further feature, the at least one valve coupling extending from each one of the plurality of standpipes extends horizontally and at a forty five degree angle relative to a front of the standpipe apparatus.

In accordance with a further feature, the feed pipe is mounted on the pair of feet such that the feed pipe is raised above a level of the pair of feet.

In accordance with a further feature, each one of the plurality of standpipes further includes a pressure gauge that indicates a water pressure inside of the respective one of the plurality of standpipes.

In accordance with a further feature, at least one of the plurality of standpipes includes a sprinkler valve that is configured to connect to a sprinkler head system.

In accordance with a further feature, the apparatus can further include a hose rack for storing rolled fire hoses, the hose rack being coupled between two of the plurality of standpipes and a respective one of the plurality of brace members coupled to each of the two of the plurality of standpipes on a back side of the plurality of standpipe.

In accordance with a further feature, the apparatus can further include an alarm panel that is configured to be electrically coupled to at least one of a sensor of a field adjustable pressure reducing valve or an isolation valve that is coupled fluidically between the at least one of the plurality of standpipes and the feed pipe.

In accordance with some embodiments of the inventive disclosure, there is provided a mobile standpipe training apparatus that includes a base and a feed pipe mounted on the base. The feed pipe has a coupling at a first end of the feed pipe. The apparatus can further include a standpipe fluidly coupled to the feed pipe, where the standpipe extends vertically relative to the feed pipe. The standpipe can have at least two couplings located along the standpipe; each one of the at least two coupling configured to receive a field adjustable pressure reducing valve.

In accordance with a further feature, the base includes a pair of feet spaced apart from each other. The feed pipe is mounted on and to each of the pair of feet and above the pair of feet. The base further includes a cross member that is joined to each one of the pair of feet opposite the feed pipe.

In accordance with a further feature, the apparatus can further include a brace member coupled between the standpipe and the cross member.

In accordance with a further feature, the apparatus can further include a brace member coupled to the standpipe and the base.

In accordance with a further feature, the apparatus can further include an isolation valve coupled between the feed pipe and the standpipe.

In accordance with a further feature, the apparatus can further include at least one additional standpipe that is fluidly coupled to the feed pipe, the at least one additional standpipe extending vertically relative to the feed pipe, the at least one additional standpipe having at least two couplings locating along the at least one additional standpipe; each one of the at least two couplings configured to receive a field adjustable pressure reducing valve.

In accordance with a further feature, the standpipe further comprises a sprinkler valve coupled at a top of the standpipe.

In accordance with some embodiments of the inventive disclosure, there is further provided a method that is particularly suited for training firefighters in the use and operation of standpipes for high rise buildings. The method includes providing a mobile standpipe training apparatus, the stand pipe training apparatus having a base and a feed pipe mounted on the base. The feed pipe having a coupling configured to connected to a water source, the feed pipe having a horizontal axis. The apparatus further having a plurality of standpipes, each one of the plurality of standpipes being fluidly coupled to the feed pipe at a respective point along the horizontal axis of the feed pipe through an isolation valve, each one of the plurality of standpipes having at least two coupling, each one of the at least two couplings being configured to couple to a field adjustable pressure reducing valve. The method further including selecting, in accordance with a training exercise, a type of a field adjustable pressure reducing valve from among a plurality of types of field adjustable pressure reducing valves and coupling a field adjustable pressure reducing valve of the selected type to one of the at least two couplings on one of the plurality of standpipes. The method further including providing water under pressure to the feed pipe and coupling a fire hose to the field adjustable pressure reducing valve of the selected type. The method can further include adjusting a pressure control of the field adjustable pressure reducing valve of the selected type to a preselected pressure level.

In accordance with a further feature, the method can further include adjusting at least one of the isolation valves to a preselected pressure in the respective standpipe.

Although the invention is illustrated and described herein as embodied in a standpipe firefighter training apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
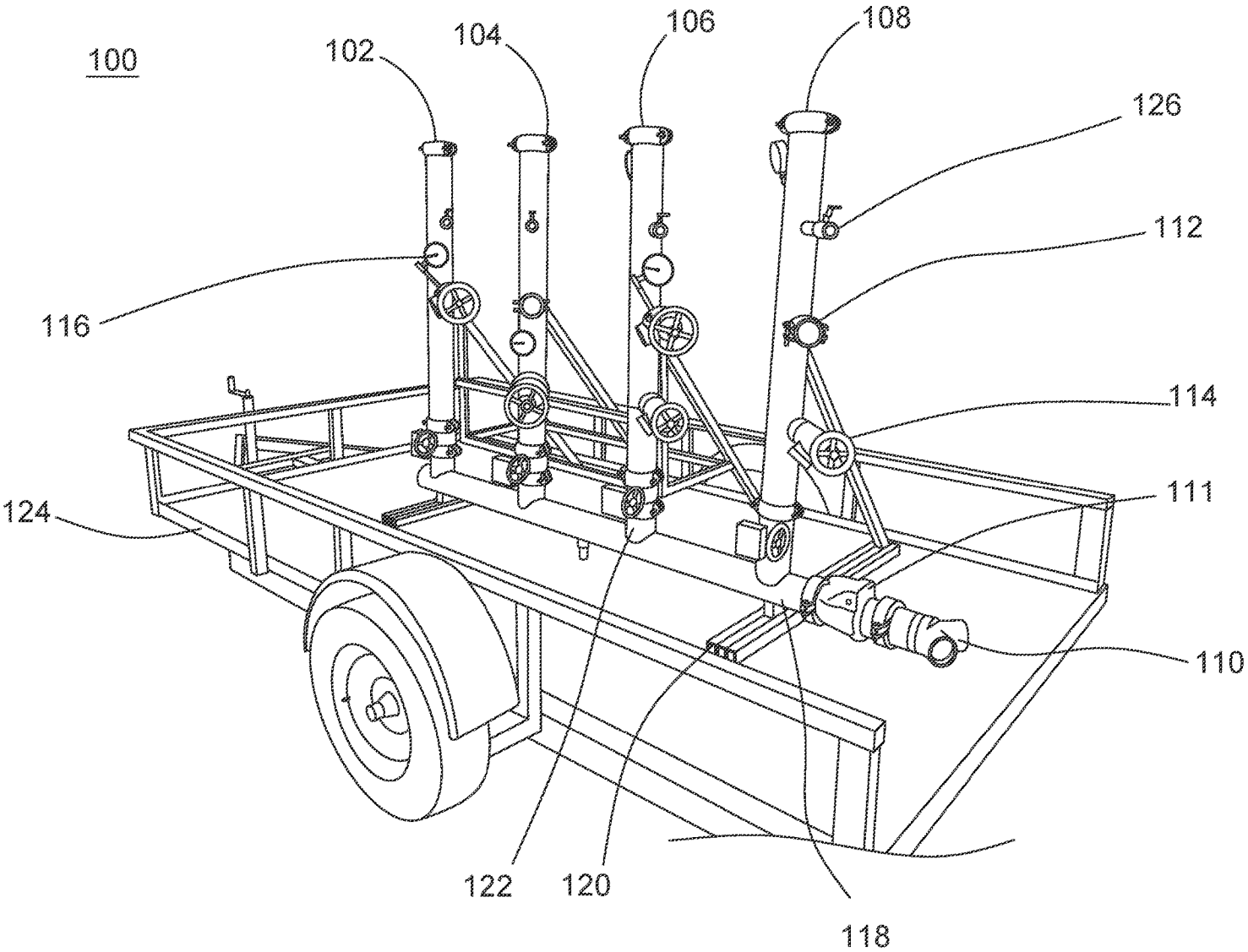
FIG. 1 is a first view of a mobile standpipe field adjustable pressure reducing valve training apparatus, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Embodiments of the inventive disclosure provide a mobile standpipe field adjustable pressure reducing valve training apparatus which provides several varieties of valves to be interchangeably mounted on the apparatus. The apparatus includes fittings to receive water under pressure that is provided to the various valves mounted on the apparatus. Training exercises can then be performed on the apparatus. The training apparatus solves the problem of committing resources to training and removing them from a given firehouse by allowing the training apparatus to be moved to a firehouse to conduct training at the firehouse. Should a need for firehouse resources arise, the training can be terminated so that personnel can respond to the emergency event.

As used herein, the term "field adjustable pressure reducing valve" (FAPRV) refers specifically to pressure reducing valves that allow adjustment of the internal hydraulic pressure controls. These valves feature a manual open and close control (typically a wheel), as well as a separate pressure adjustment control to adjust the internal hydraulic control components. An example of such a valve is that sold under the tradename "URFA" under the brand name ELKHART BRASS, by Manufacturers Distributor, Inc. Another example is sold under the trade name "PRESSURE-TRU" by Zurn Industries, LLC. The field adjustable control distinguishes this type of valve from conventional pressure reducing valve. Furthermore, FAPRVs can have electric/electronic sensor such as a supervisory switch to indicate when the FAPRV is opened when it is closed. Further, a FAPRV can include a tamper sensor provide an electric signal that indicates that the FAPRV may have been subject to unauthorized use or tampering. Some FAPRVs may include a tamper indicator on the FAPRV that can visually indicate unauthorized use or tampering has occurred. The term "isolation valve" refers to a valve used to connect a standpipe to a feed pipe, and to control the pressure in the standpipe relative to the feed pipe. An isolation valve can be a conventional pressure reducing valve that regulates pressure to a selected pressure level, or it can be a pressure restricting valve that creates a pressure differential between the feed pipe and the standpipe, or it can be a FAPRV. The term "standpipe" refers to a type of rigid water piping which is built into multi-story buildings in a vertical position and in the context of a building serves the same purpose as a fire hydrant. Further, as used herein, standpipe also refers to a facsimile of standpipe found in a building, and that is provided on a training apparatus as disclosed herein with fittings and couplings to which FAPRVs can be mounted.

Figure 2:
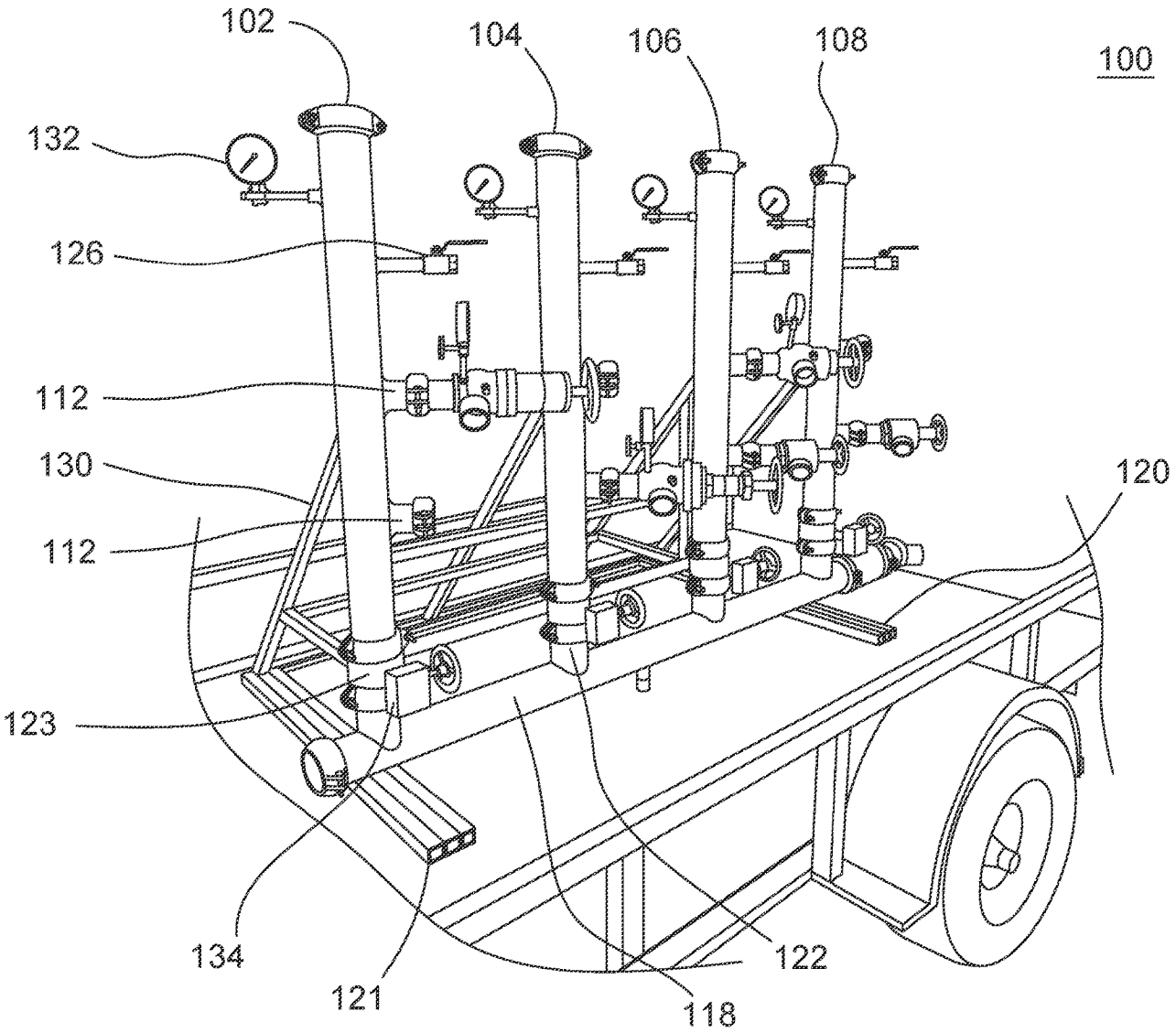
FIG. 2 is a second view of a mobile standpipe field adjustable pressure reducing valve training apparatus, in accordance with some embodiments.
Figure 3:
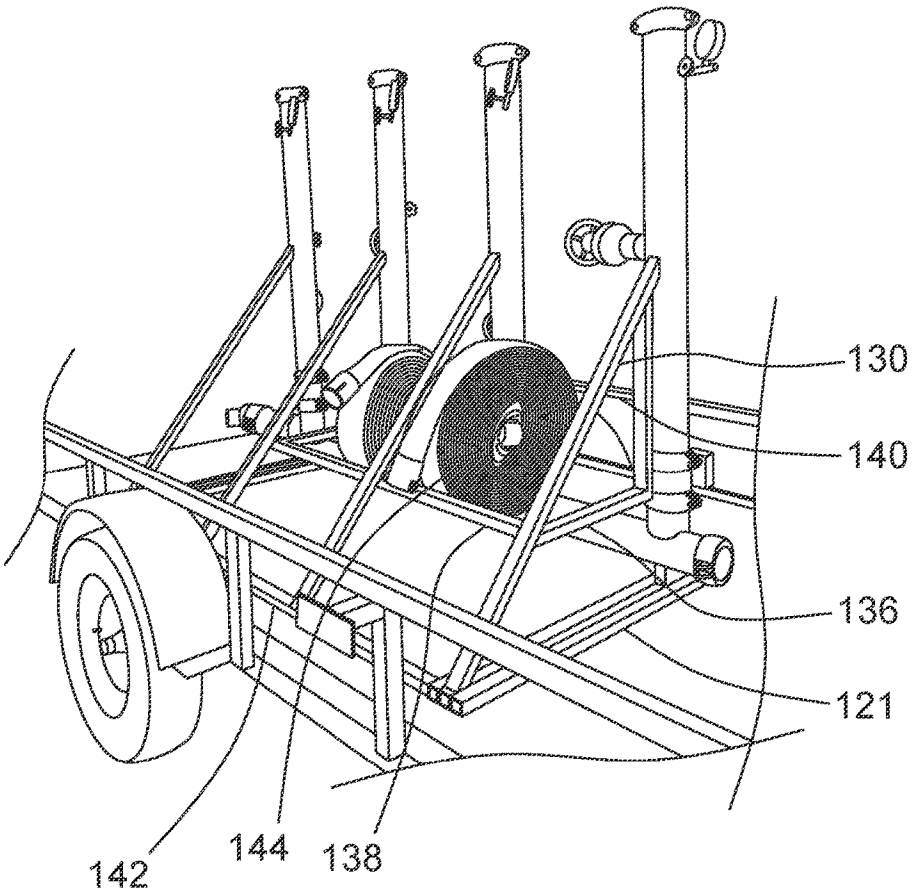
FIG. 3 is a third first view of a mobile standpipe field adjustable pressure reducing valve training apparatus, in accordance with some embodiments.

FIG. 1 is a first view of a mobile standpipe FAPRV training apparatus 100, in accordance with some embodiments. The apparatus 100 is further shown from different lateral angles in FIGS. 2-3 and FIG. shows the apparatus 100 from an overhead view. In the apparatus 100 there are a plurality of vertically arranged standpipes 102, 104, 106, 108. Each one of these standpipes 102, 104, 106, 108 is fluidly coupled to a horizontal feed pipe 118. By "fluidly coupled" it is meant that fluid traveling through the feed pipe can flow into the standpipe as well. In some embodiments the standpipe(s) 102, 104, 106, 108 can be mounted directly to the feed pipe 118, or there can be a valve coupled between the standpipe 102, 104, 106, 108 and the feed pipe 118.

The feed pipe 118 is fitted with a coupling 110 to receive water under pressure. In an actual standpipe installation in a high rise building the standpipes 102, 104, 106, 108 are fed water under pressure by a fire pump, and the pressure is higher than the preferred pressure used for firefighting equipment (e.g. hoses). Each one of the plurality of standpipes 102, 104, 106, 108 includes one or more horizontally oriented valve couplings such as coupling 112 to which a FAPRV can be coupled, such as valve 114. The pressure in each standpipe is indicated by a pressure gauge 132 which can be mounted to an appropriate coupling on the side of the standpipe. The couplings 112 are standardized, and so a variety of different types and models of FAPRVs, which have coupling features that are designed according to the coupling standard, can be mounted on the apparatus 100. Each FAPRV 114 can be manually adjusted to flow water at a controlled, selected pressure as controlled by the valve adjustment for the particular FAPRV 114. Firefighting equipment is preferably operated at specific pressure ranges, so the FAPRV to which such equipment is connected must be adjusted so as to output water at a pressure within that desired pressure range. Some FAPRVs will have pressure gauges 116 to indicate the adjusted pressure.

At the base (e.g. 122) of each standpipe is an isolation valve 123 that can be used to control pressure at each respective standpipe 102, 104, 106, 108 or to shut off a one or more standpipes when they are not being used for a given training exercise or demonstration. Furthermore, electric flow sensors (e.g. 134) are provided that can be coupled to an alarm panel. The flow sensors 134 will allow an alarm panel to indicate which standpipe is experiencing flow, and how much.

Water is fed to the apparatus through coupling 110 under high pressure to simulate a fire pump, and the water passes through a check valve 111. Pressure in each standpipe 102, 104, 106, 108 can be adjusted by the isolation valves 123 to a different (lower) pressure than the feed pressure in order to simulate the effect of pressure at standpipes on different floors of a building. Therefore, using the apparatus as shown, with four standpipes 102, 104, 106, 108, the pressure at four different floors of a building can be simulated for a training exercise. At the top of each standpipe 102, 104, 106, 108 is a sprinkler shut off valve (e.g. 126), which allows hookup to sprinkler head for training in the operation and shut off of various types of sprinkler systems in conjunction with use of a fire hose coupled to the standpipe through a FAPRV 114.

The apparatus includes a base on which the feed pipe is mounted. The base is moveable, and can be a platform, or comprised of feet 120, 121 at each end of the apparatus which are horizontal stabilizing structures that keep the apparatus upright during training exercises. In general, the base of the apparatus 100 is not fixed in place, and allows the apparatus 100 to be moved from location to location, making the apparatus mobile. However, the apparatus 100 can, in some embodiments, be fixedly mounted on a mobile platform, such as a trailer. The standpipes 102, 104, 106, 108 can be braced using brace members such as brace member 130 at each standpipe 102, 104, 106, 108 that couples the standpipe 102, 104, 106, 108 to a cross member 142 that joins the feet 120, 121 at their distal ends, opposite the proximal ends of the feet 120, 121 where the feed pipe 118 is mounted. Similarly cross member 140 forms part of the base along with the feet 120, 121 and runs horizontally along the back side of the standpipes 102, 104, 106, 108, and at a higher level than cross member 138.

Thus, each standpipe 102, 104, 106, 108 is coupled to, and supported on the feed pipe 118 through a respective isolation valve 123. The feed pipe 118 is mounted on, and supported by two or more feet member 120, 121 that can run in a direction perpendicular to an axis of the feed pipe 118. The feed pipe 118 is positioned over one end (e.g. the proximal end) of the feet 120, 121. This provides access to the standpipes 102, 104, 106, 108 while minimizing obstruction at the ground level. To stabilize the standpipes 102, 104, 106, 108, each one is braced to the distal side of the feet 120, 121, either directly to the distal side, or to a cross member 142 that runs parallel to the feed pipe 118 and between the distal ends of the feet 120, 121. Each brace on each standpipe 102, 104, 106, 108 can simply be a straight member that coupled to each standpipe 102, 104, 106, 108 about halfway up the height of the standpipe 102, 104, 106, 108 to the distal side of the feet 120, 121. A rectangular base is formed by the feet 120, 121, cross member 142 and feed pipe 118. Notably, the feed pipe 118 is raised above the feet 120, 121, and there can be no cross member across the proximal ends of the feet 120, 121, leaving space under the feed pipe 118 between the feet 120, 121 which eliminates obstructions. In some embodiments the feet 120, 121 can extend forward of the feed pipe 118 by a short distance. In some embodiments additional horizontal member 136, 138, 140 can be used to provide additional bracing as well as to form a hose rack in conjunction with the main braces 130.

The apparatus 100 is sized so that it can be moved on a trailer 124. Being mobile allows the apparatus 100 to be moved from house to house (firefighting houses) for training personnel. This eliminates the need for personnel to travel to a training facility, conserving resources without upsetting the ability of a given house to respond to calls, a occurs when a house has to send an engine to a training facility with crew. In some embodiments, an apparatus 100 having 4 standpipes 102, 104, 106, 108 can have a base perimeter on the order of four feet by eight feet, and the standpipes can be six to eight feet tall.

The apparatus 100, in addition to providing multiple different valve types to operate for training so that firefighters can become familiar and experience in operating the various types of FAPRVs that they may encounter in in the field of their region, can also provide rack space formed by the stabilizing brace members 130, with the addition of, for example, cross member 140 between the standpipes, brace member 136 and cross member 138. These form a rack on which coiled hoses 144 can be loaded and carried with the apparatus. Additional members or panels can be added to allow carrying smaller items as well.

Figure 4:
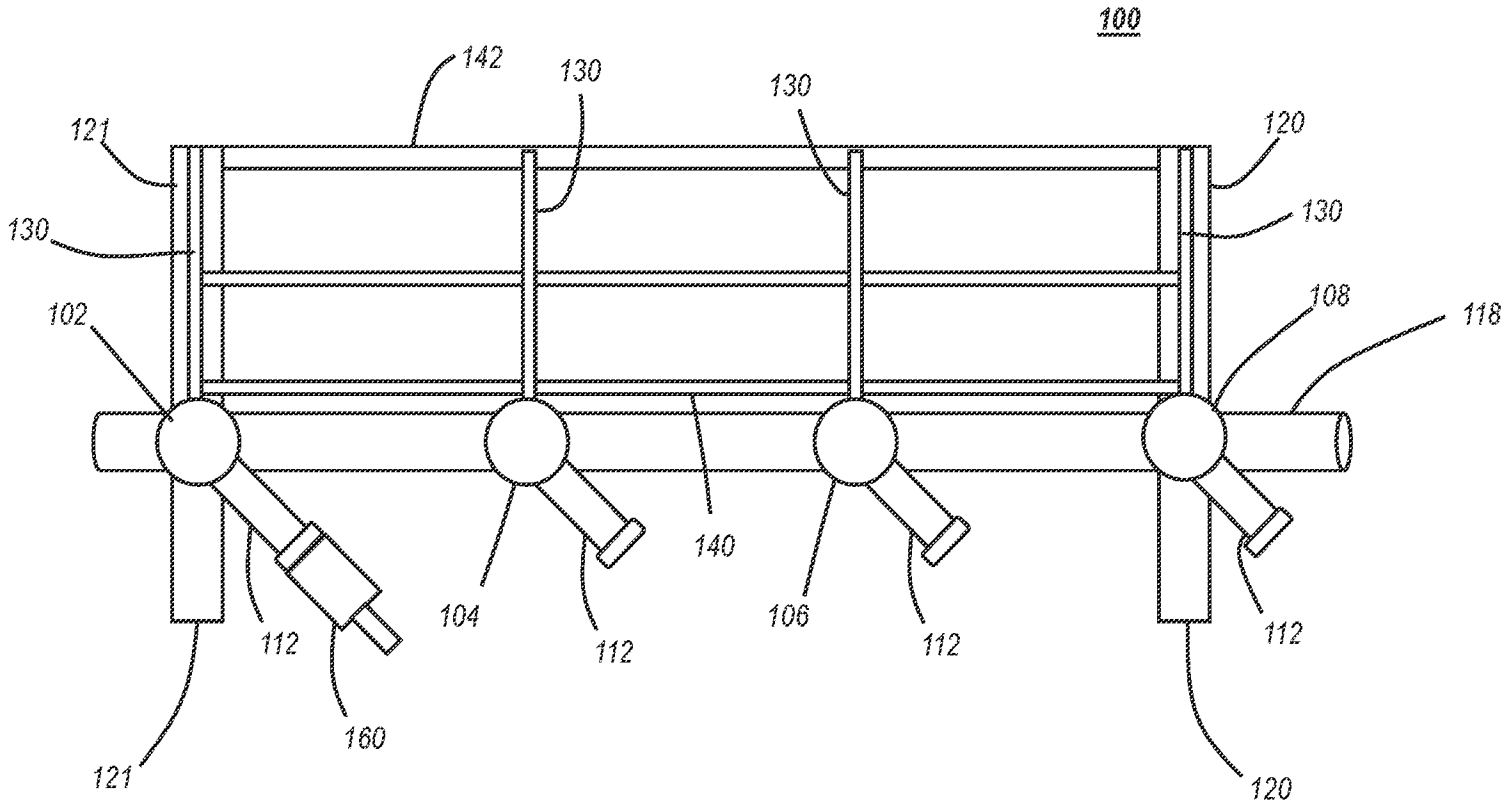
FIG. 4 is a top (overhead) plan of a mobile standpipe field adjustable pressure reducing valve training apparatus, in accordance with some embodiments.

FIG. 4 is a top (overhead) plan of a mobile standpipe FAPRV training apparatus, in accordance with some embodiments. This view shows the apparatus substantially as show in FIGS. 1-3, including standpipes 102, 104, 106, 108. In this view it can be seen that valve couplings 112 are at an angle to the line formed by the standpipes 102, 104, 106, 108 and the feed pipe 118. In some embodiments the angle can be about 45 degrees to the line formed by the row of standpipes. By angling the valve coupling outward, longer valves can be placed on the couplings without concern of space to the next standpipe. FAPRV 160 is shown mounted on a valve coupling 112. The FAPRV 160 is adjustable so that the pressure of the water flowing out of the valve can be regulated. The other valve couplings are shown capped off, without any valve attached to them.

Figure 5:
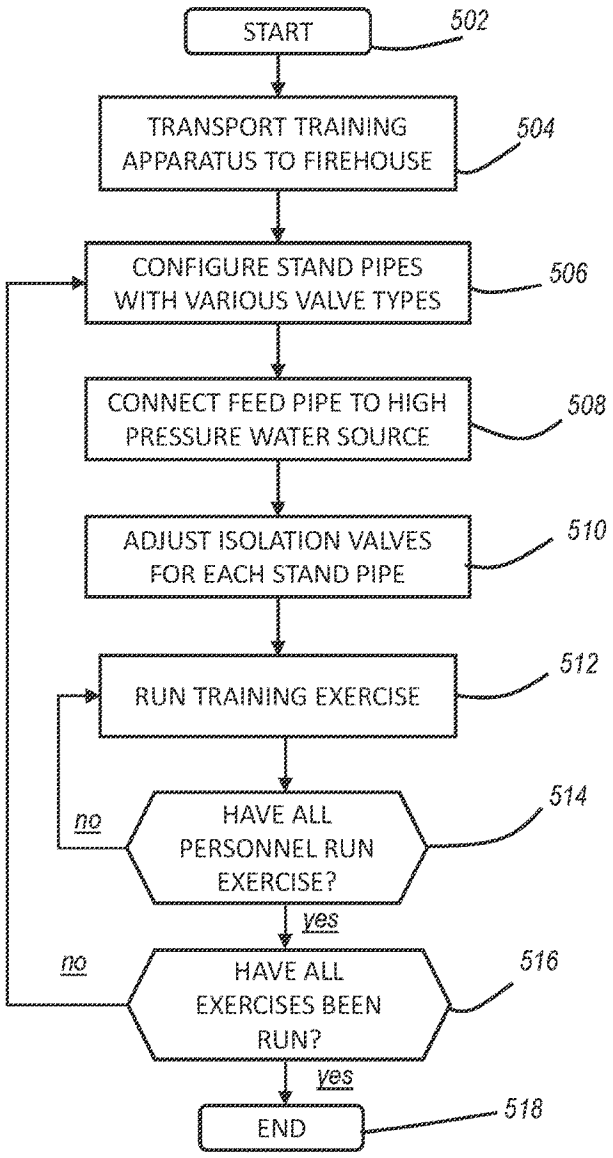
FIG. 5 shows a flow chart diagram of a method for using a mobile standpipe field adjustable pressure reducing valve training apparatus, in accordance with some embodiments.

FIG. 5 shows a flow chart diagram of a method 500 for using a mobile standpipe FAPRV training apparatus, in accordance with some embodiments. At the start 502, a mobile standpipe FAPRV apparatus is provided such as that show in FIGS. 1-4. In general the apparatus has a feed pipe that is supported by a base. The base can comprise a platform or several feet that span a width. The feed pipe has a feed coupling at one end for coupling to a water source from which water is provided to the apparatus under pressure. A check valve can be provided after the feed coupling. One or more standpipes are fluidly coupled to the feed pipe. In some embodiments the one or more standpipes can be directly mounted on the feed pipe. For each standpipe there can be a respective isolation valve coupled between the standpipe and the feed pipe to control pressure in the standpipe. Where multiple standpipes are used, the respective isolation valves can set each standpipe to a different operating pressure. Each standpipe can have couplings for one or more pressure regulation valves that have fitting for fire hoses, and each standpipe can have a sprinkler shutoff valve. In step 504 the apparatus can be transported to a training location, such as a firehouse or fire station. Once on site, in step 506 the apparatus can be set up by situating the apparatus in an appropriate location and connecting various types of FAPRVs to the standpipes, connecting the flow meters and sensors on the apparatus to an alarm panel and so on for a given training exercise. In step 508 a high pressure water source is connected to the feed pipe. The water can be from a fire hydrant, a pump engine, or any other source that can provide sufficient pressure to similar pressure levels found in standpipes in high rise buildings. In step 510 the different standpipes can be set to different pressure levels by adjustment of an isolation valve at the bottom of each standpipe, which controls pressure between the feed pipe and the respective standpipe. Once the apparatus is set up, then in step 512 a training exercise can be run. A training exercise can include, for example, coupling a fire hose to one of the FAPRVs, using a tool for the particular FAPRV to adjust the flow pressure into the hose to a selected pressure, then operating the hose. A similar exercise can be run for each of several different types of FAPRVs that each have different controls and can be operated using different tools. Numerous other scenarios can be devised and set up including reading an alarm panel to determine what equipment is causing an alarm, and then clearing the alarm by operating or resetting equipment on the apparatus. For example, there can be tamper sensors on the FAPRVs, and flow sensors in a standpipe to detect flow through the standpipe. Various events can be simulated for training events.

In step 514 the exercise can be reset and repeated for different personnel, or for the same personnel for the sake of repetition. In step 516 different training exercises can be run where the apparatus is set up different to similar different conditions. When the training exercises are concluded then the method ends 518.

Figure 6:
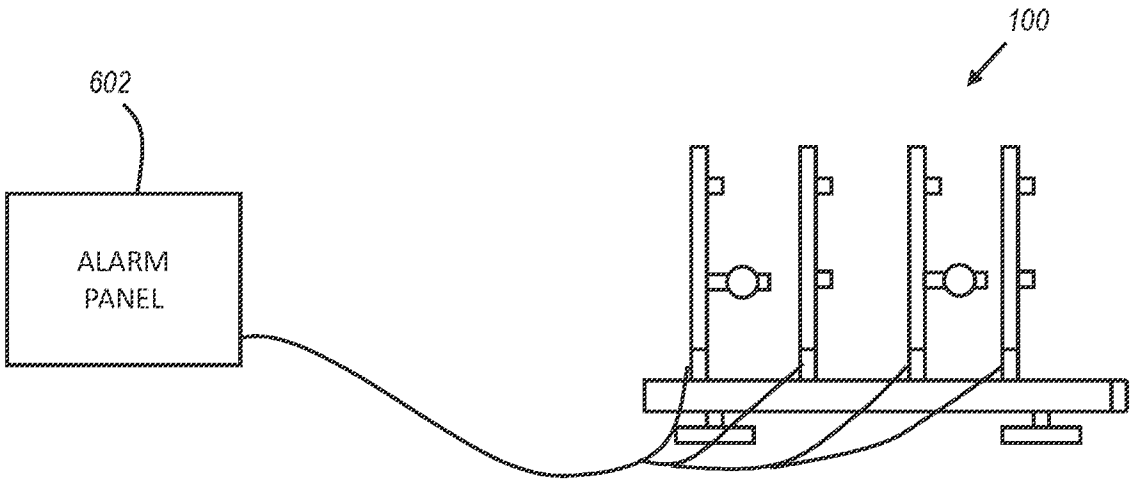
FIG. 6 shows a schematic diagram of a deployed mobile standpipe field adjustable pressure reducing valve training apparatus connected to an alarm panel, in accordance with some embodiments.

FIG. 6 shows a schematic diagram of a deployed mobile standpipe field adjustable pressure reducing valve training apparatus 100 including an alarm panel 602, in accordance with some embodiments. Some types of FAPRVs have electric sensors to detect usage or tampering. These sensors can be connected to an alarm panel 602. The alarm panel 602 includes a display for indicting which equipment has experienced or is experiencing an unusual condition. For example, a flow sensor in a standpipe may detect the flow of water through the standpipe. This can mean a FAPRV has been opened, or may be malfunctioning (leaking), or a sprinkler system may have been activated. The alarm panel 602 can also operate audio alarms, such as bells, speakers, etc. Thus, the alarm panel 602 can be configured as part of a training exercise since firefighters may have to investigate and clear alarm conditions and operate alarm panels in the field.

The disclosed standpipe training apparatus solves the problem of having a fixed standpipe training facility that requires firefighter to travel to the facility, which commits resources to the training that will not be available at the firefighter's home station or firehouse. These problems are solved by a mobile standpipe training apparatus that can be moved, such as on a trailer, from firehouse to firehouse. The training apparatus is reconfigurable so that different types of training can be performed, different types of standpipe equipment can be used, and different training scenarios can be conducted, all without the firefighters having to leave their firehouse or station.

What is claimed is:

1. A mobile standpipe training apparatus for training firefighters, comprising: a feed pipe having a first end and a second end, the second end being closed, the first end being configured to receive water under pressure; a plurality of standpipes, each one of the plurality of standpipes extending upwards from the feed pipe, and being fluidly coupled to the feed pipe at a base of the standpipe and closed or capped at a top of the standpipe; each one of the plurality of standpipes having at least one valve coupling extending from a side of the standpipe, the at least one valve coupling configured to receive a field adjustable pressure reducing valve; each one of the plurality of standpipes having an isolation valve fluidly coupled in the each one of the plurality of standpipes between the feed pipe and the at least one valve coupling extending from the side of each one of the plurality of standpipes, and wherein each isolation valve of each one of the plurality of standpipes is adjusted such that a pressure in the respective each one of the plurality of standpipes is set to a different pressure to approximate different pressure levels on different floors of a building among the plurality of standpipes; a pair of feet coupled to a bottom of the feed pipe configured to hold the standpipe apparatus upright, wherein one of pair of feet is disposed adjacent the first end of the feed pipe and the other of the pair of feet is disposed at the adjacent the second end of the feed pipe; a cross member having a first end coupled to a distal end of the one of the feet adjacent the first end of the feed pipe and a second end coupled to a distal end of the other of the feet adjacent the second end of the feed pipe; and a plurality of brace members, wherein each one of the brace members is coupled to a respective one of the plurality of standpipes and the cross member.

2. The mobile standpipe training apparatus of claim 1, wherein the at least one valve coupling extending from each one of the plurality of standpipes extends horizontally and at a forty five degree angle relative to a front of the standpipe apparatus.

3. The mobile standpipe training apparatus of claim 1, wherein the feed pipe is mounted on the pair of feet such that the feed pipe is raised above a level of the pair of feet.

4. The mobile standpipe training apparatus of claim 1, wherein each one of the plurality of standpipes further includes a pressure gauge that indicates a water pressure inside of the respective one of the plurality of standpipes.

5. The mobile standpipe training apparatus of claim 1, wherein at least one of the plurality of standpipes includes a sprinkler valve that is configured to connect to a sprinkler head system.

6. The mobile standpipe training apparatus of claim 1, further comprising a hose rack for storing rolled fire hoses, the hose rack being coupled between two of the plurality of standpipes and a respective one of the plurality of brace members coupled to each of the two of the plurality of standpipes on a back side of the plurality of standpipe.

7. The mobile standpipe training apparatus of claim 1, further comprising an alarm panel that is configured to be electrically coupled to at least one of a sensor of a field adjustable pressure reducing valve or an isolation valve that is coupled fluidically fluidly between the at least one of the plurality of standpipes and the feed pipe.

8. A mobile standpipe training apparatus, comprising: a base that is moveable; a feed pipe mounted on the base; the feed pipe having a coupling at a first end of the feed pipe; a plurality of standpipes that are each fluidly coupled to the feed pipe through a respective one of a plurality of isolation valves, each one of the plurality of standpipes extending vertically relative to the feed pipe, each isolation valve being each other to approximate different pressure levels on different floors of a building; and each one of the plurality of standpipes having at least two couplings located along the standpipe; each one of the at least two couplings on each one of the plurality of standpipes configured to receive a field adjustable pressure reducing valve.

9. The mobile standpipe training apparatus of claim 8, wherein the base comprises:

a pair of feet spaced apart from each other, wherein the feed pipe is mounted on and to each of the pair of feet and above the pair of feet; and a cross member that is joined to each one of the pair of feet opposite the feed pipe.

10. The mobile standpipe training apparatus of claim 9, further comprising a brace member coupled between at least one of the plurality of standpipes and the cross member.

11. The mobile standpipe training apparatus of claim 8 further comprising a brace member coupled to at least one of the plurality of standpipes and the base.

12. The mobile standpipe training apparatus of claim 8, wherein at least one of the plurality of standpipes further comprises a sprinkler valve coupled at a top of the at least one of the plurality of standpipes.

13. A method, comprising:

providing a mobile standpipe training apparatus, the stand pipe training apparatus having:

a base;

a feed pipe mounted on the base, the feed pipe having a coupling configured to connect to a water source, the feed pipe having a horizontal axis;

a plurality of standpipes, each one of the plurality of standpipes being fluidly coupled to the feed pipe at a respective point along the horizontal axis of the feed pipe through a respective isolation valve, each one of the plurality of standpipes having at least two coupling, each one of the at least two couplings being configured to couple to a field adjustable pressure reducing valve;

selecting, in accordance with a training exercise, a type of a field adjustable pressure reducing valve from among a plurality of types of field adjustable pressure reducing valves and coupling a field adjustable pressure reducing valve of the selected type to one of the at least two couplings on one of the plurality of standpipes;

providing water under pressure to the feed pipe;

adjusting the isolation valve of each one of the plurality of standpipes to different pressure levels such that each one of the plurality of standpipes to approximate different pressure levels on different floors of a building among the plurality of standpipes;

coupling a fire hose to the field adjustable pressure reducing valve of the selected type; and adjusting a pressure control of the field adjustable pressure reducing valve of the selected type to a preselected pressure level.

* * * * *